US008514209B2

(12) United States Patent
Ikeda et al.

(10) Patent No.: US 8,514,209 B2
(45) Date of Patent: Aug. 20, 2013

(54) DISPLAY APPARATUS AND METHOD FOR DRIVING THE SAME

(75) Inventors: Kouji Ikeda, Chiba (JP); Masami Iseki, Mobara (JP)

(73) Assignee: Canon Kabushiki Kaisha, Tokyo (JP)

( * ) Notice: Subject to any disclaimer, the term of this patent is extended or adjusted under 35 U.S.C. 154(b) by 543 days.

(21) Appl. No.: 12/820,498

(22) Filed: Jun. 22, 2010

(65) Prior Publication Data

US 2011/0025653 A1 Feb. 3, 2011

(30) Foreign Application Priority Data

Jul. 29, 2009 (JP) ..... 2009-175967

(51) Int. Cl.
*G09G 5/00* (2006.01)

(52) U.S. Cl.
USPC ..... 345/204; 345/76

(58) Field of Classification Search
None
See application file for complete search history.

(56) References Cited

U.S. PATENT DOCUMENTS

| | | | |
|---|---|---|---|
| 5,302,871 | A | 4/1994 | Matsuzaki et al. |
| 5,963,184 | A | 10/1999 | Tokunaga et al. |
| 6,188,378 | B1 | 2/2001 | Yamamoto et al. |
| 6,335,720 | B1 | 1/2002 | Mori et al. |
| 6,348,910 | B1 | 2/2002 | Yamamoto et al. |
| 6,373,454 | B1 | 4/2002 | Knapp et al. |
| 6,552,709 | B1 | 4/2003 | Yamaguchi |
| 6,559,824 | B1 | 5/2003 | Kubota et al. |
| 6,587,086 | B1 | 7/2003 | Koyama |
| 6,661,180 | B2 | 12/2003 | Koyama |
| 7,126,565 | B2 | 10/2006 | Kawasaki et al. |
| 7,242,397 | B2 | 7/2007 | Iseki et al. |
| 7,253,812 | B2 | 8/2007 | Sasaki |
| 7,259,735 | B2 | 8/2007 | Kasai |
| 7,479,972 | B2 * | 1/2009 | Takai ..... 345/690 |

(Continued)

FOREIGN PATENT DOCUMENTS

| | | |
|---|---|---|
| CN | 1521719 A | 8/2004 |
| CN | 1770246 A | 5/2006 |

(Continued)

*Primary Examiner* — Jason Olson
(74) *Attorney, Agent, or Firm* — Fitzpatrick, Cella, Harper & Scinto

(57) ABSTRACT

A display apparatus includes a plurality of pixels arranged in two-dimensions, each pixel including a pixel circuit and a light emitting element for emitting light at a luminance corresponding to a data signal, a data line, connected to each pixel circuit, for writing the data signal, and a light emitting period control signal line for supplying a light emitting period control signal. Each pixel circuit includes a light emitting element drive unit for supplying a current or voltage corresponding to the data signal to the light emitting element, and a light emitting period control unit for controlling a light emitting period of the light emitting element by the light emitting period control signal. The light emitting period control signals have two or more light emitting period control signals, and the respective pixels are divided into two or more groups by grouping the respective pixels disposed in a same row at least into a same group. Pixels in a same row are scanned in every other row and neighboring rows are sequentially scanned for writing the data signal, and the light emitting elements have an equal light emission duty and are controlled by the light emitting period control signal different on a group basis and controlled so that a time between an endpoint of a writing period within one field period and a start point of a light emitting period within the one field period is different for different groups.

13 Claims, 11 Drawing Sheets

(56) References Cited

U.S. PATENT DOCUMENTS

| | | | | |
|---|---|---|---|---|
| 7,532,207 | B2 | 5/2009 | Kawasaki et al. | |
| 7,605,899 | B2 | 10/2009 | Shikina et al. | |
| 7,692,643 | B2 | 4/2010 | Kawasaki et al. | |
| 7,812,812 | B2 | 10/2010 | Yoshinaga et al. | |
| 7,911,425 | B2 * | 3/2011 | Goden et al. | 345/76 |
| 2002/0047581 | A1 | 4/2002 | Koyama | |
| 2003/0058687 | A1 | 3/2003 | Kimura | |
| 2004/0155843 | A1 | 8/2004 | Sasaki | |
| 2004/0183752 | A1 | 9/2004 | Kawasaki et al. | |
| 2005/0007316 | A1 | 1/2005 | Akimoto et al. | |
| 2005/0007319 | A1 * | 1/2005 | Shin et al. | 345/76 |
| 2005/0041002 | A1 | 2/2005 | Takahara et al. | |
| 2005/0122150 | A1 | 6/2005 | Iseki et al. | |
| 2005/0285151 | A1 | 12/2005 | Kawasaki | |
| 2006/0061529 | A1 | 3/2006 | Kim | |
| 2006/0114194 | A1 | 6/2006 | Kawasaki et al. | |
| 2006/0114195 | A1 | 6/2006 | Yamashita et al. | |
| 2006/0132395 | A1 | 6/2006 | Kawasaki et al. | |
| 2006/0187185 | A1 | 8/2006 | Yoshinaga et al. | |
| 2006/0267509 | A1 | 11/2006 | Yang | |
| 2007/0132719 | A1 | 6/2007 | Yamashita et al. | |
| 2007/0257867 | A1 | 11/2007 | Kasai | |
| 2007/0257868 | A1 | 11/2007 | Kasai | |
| 2008/0007494 | A1 | 1/2008 | Kim et al. | |
| 2008/0157828 | A1 | 7/2008 | Kawasaki et al. | |
| 2008/0158112 | A1 | 7/2008 | Kawasaki et al. | |
| 2008/0259000 | A1 | 10/2008 | Kawasaki | |
| 2009/0015571 | A1 | 1/2009 | Kawasaki et al. | |
| 2009/0033599 | A1 | 2/2009 | Kawasaki et al. | |
| 2009/0066615 | A1 | 3/2009 | Kawasaki | |
| 2009/0085908 | A1 | 4/2009 | Kawasaki et al. | |
| 2009/0102853 | A1 | 4/2009 | Kawasaki et al. | |
| 2009/0109144 | A1 | 4/2009 | Goden et al. | |
| 2009/0121980 | A1 | 5/2009 | Kawasaki et al. | |
| 2009/0135110 | A1 | 5/2009 | Nakamura et al. | |
| 2009/0231239 | A1 | 9/2009 | Goden et al. | |
| 2009/0289966 | A1 | 11/2009 | Ikeda et al. | |
| 2010/0026677 | A1 | 2/2010 | Shikina et al. | |
| 2010/0073267 | A1 | 3/2010 | Akimoto et al. | |
| 2010/0128160 | A1 | 5/2010 | Maru et al. | |
| 2010/0328365 | A1 | 12/2010 | Ikeda et al. | |
| 2011/0001689 | A1 | 1/2011 | Maru et al. | |
| 2011/0025653 | A1 * | 2/2011 | Ikeda et al. | 345/204 |
| 2011/0090210 | A1 | 4/2011 | Sasaki et al. | |

FOREIGN PATENT DOCUMENTS

| | | | |
|---|---|---|---|
| EP | 1 429 312 | A2 | 6/2004 |
| JP | 11-282417 | A | 10/1999 |
| JP | 2001-134229 | A | 5/2001 |
| JP | 2009-159877 | A | 6/2001 |
| JP | 2004-3411144 | A | 12/2004 |
| JP | 2006-030516 | A | 2/2006 |
| JP | 2005-157322 | A | 6/2006 |
| JP | 2008-268981 | A | 11/2008 |
| JP | 2008-015516 | A | 12/2008 |

* cited by examiner

DISPLAY APPARATUS AND METHOD FOR DRIVING THE SAME

BACKGROUND OF THE INVENTION

1. Field of the Invention

The present invention relates to a display apparatus in which self luminous elements are arranged in a matrix form, and a method for driving the same.

2. Description of the Related Art

In display apparatuses of CRT, liquid crystal, organic EL and the like, a refresh operation of rewriting a video frame to be displayed several tens times in one second is performed, and the frame rewrite frequency is called a refresh rate. When the refresh rate is low, a flicker (flickering) occurs. Therefore, the refresh rates of these display apparatuses are usually set at the frequency (60 Hz) at which flickers do not occur. An organic EL display apparatus uses a self luminous display element for each pixel, and emits light and displays an image by passing a current to each of the light emitting elements. The brightness of the display screen can be set according to the light emitting time and light emitting intensity in one frame. Depending on the frequency of light emission, and the ratio (duty ratio) of the light emitting time and non-light emitting time in one frame, human eyes visually recognize the difference of light emission (bright part) and non-light emission (dark part), and recognizes the difference as a flicker (flickering) of the display screen. Accordingly, even if an image is displayed at the refresh rate of 60 Hz, a flicker of the display screen occurs depending on the duty ratio, and the display quality is degraded. Japanese Patent Application Laid-Open No. 2006-30516 discloses the drive method that suppresses a flicker by using a duty drive method that controls the brightness of the display screen according to a duty ratio.

However, when on-off drive is performed with a certain duty ratio according to the method for driving the display apparatus described in Japanese Patent Application Laid-Open No. 2006-30516, the total current amount that flows into the display region varies according to time, and the current variation acts on the power supply impedance having a finite value and brings about a power supply variation. When one field (or one frame) is divided into a plurality of sub fields (or sub frames), and the light emitting period is divided, the power supply variation and the light emitting period are synchronized with each other, and a luminance variation occurs to the display region. As a result, there arises the problem of causing degradation of image quality.

Thus, the present invention relates to a display apparatus that performs periodic on-off drive, and has an object to provide a method for driving a display apparatus that performs favorable display in which degradation of image quality caused by a power supply variation is suppressed.

SUMMARY OF THE INVENTION

A display apparatus is provided that includes: a pixel circuit connected to a data line for writing a data signal, and a light emitting period control signal line for supplying a light emitting period control signal, the pixel circuit having a light emitting element for emitting light at a luminance corresponding to the data signal, a light emitting element drive unit for supplying a current or a voltage corresponding to the data signal to the light emitting element; and a light emitting period control unit for controlling a light emitting period of the light emitting element by the light emitting period control signal. Pixels each including the pixel circuit are arranged in two-dimension. The light emitting period control signals has two or more light emitting period control signals, the respective pixels are divided into two or more groups by grouping the respective pixels disposed in a same row into a same group, and each of the light emitting elements is controlled by the light emitting period control signal different on a group basis and operates in a writing period of the data signal, a light emitting period and a non-light emitting period within one field time period, the light emitting elements has an equal light emission duty and light emissions of the light emitting elements of different groups are controlled at different light emitting timings with respect to the writing period depending on the group.

A method for driving a display apparatus is provided that includes: a first step of writing a data signal to a pixel circuit in one field period; and a second step of controlling a current or voltage supply corresponding to the data signal to a light emitting element from a light emitting element drive unit by a light emitting period control signal, and causing the light emitting element to emit at a luminance corresponding to the data signal. The light emitting period control signal has two or more light emitting period control signals, pixels in which pixel circuits are disposed are arranged in two-dimension, and are divided into two or more groups by grouping the respective pixels disposed in a same row into a same group. In the second step, each of the light emitting elements is controlled by the light emitting period control signal different on a group basis, and each of the light emitting elements operates in a light emitting period and a non-light emitting period, the light emitting elements have an equal light emission duty, and light emissions of the light emitting elements of different groups are controlled at different light emitting timing depending on a group after the first step.

According to the present invention, degradation of the image quality caused by a power supply variation is suppressed, and favorable display can be achieved.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

In the description of the present invention, one field period is set as a minimum unit period in which data necessary for displaying one image is input in a pixel, and causes the pixel to emit light until the next image data is input. Further, in one field period, the period until one field period ends after a row scanning period ends is set as a vertical blanking period. The light emission duty is the ratio of the light emitting time and non-light emitting time in one field, and if the light emitting period and the non-light emitting period are equal times, the light emission duty is described as 50%.

Figure 6:
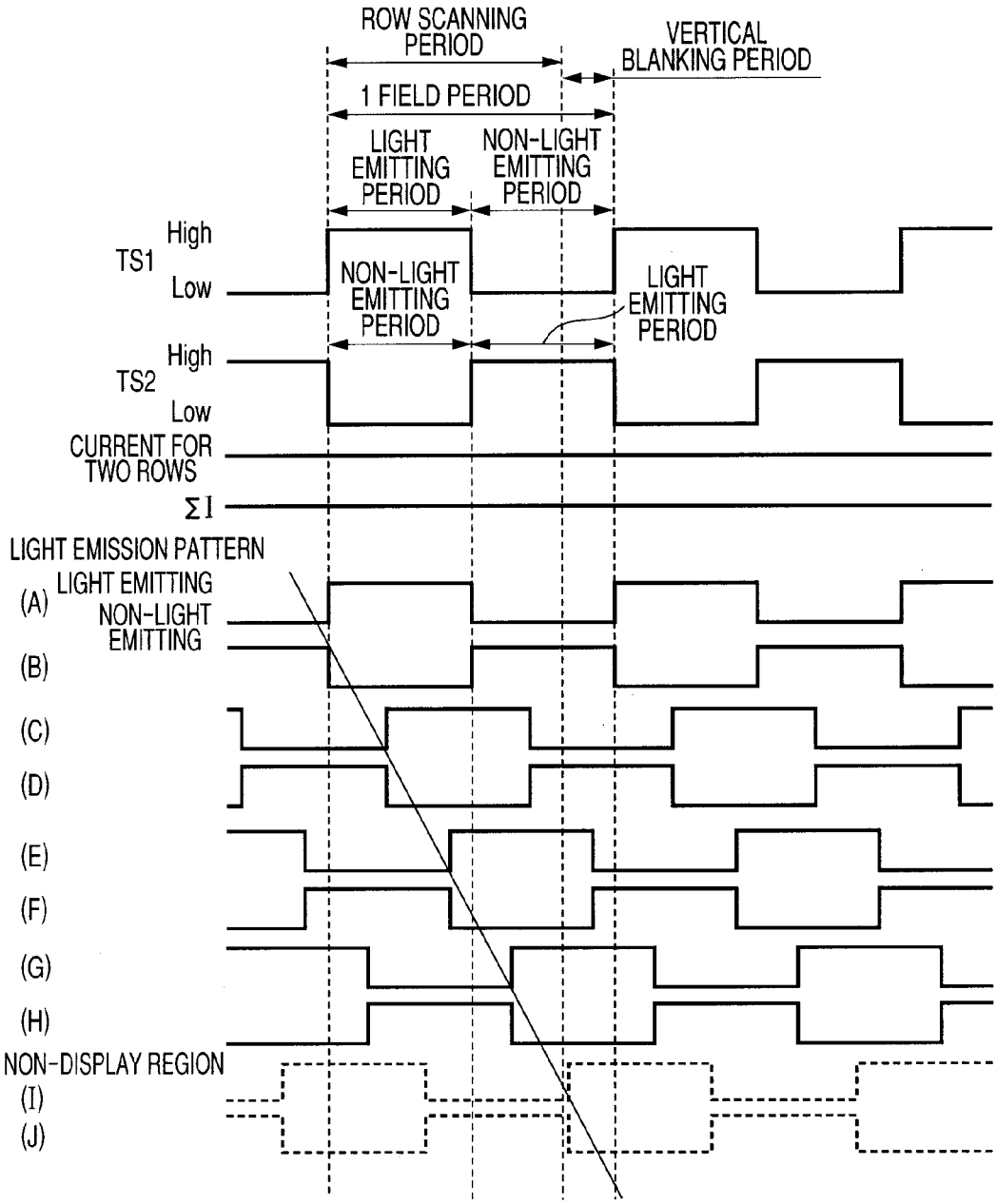
FIG. 6 is a diagram illustrating the method for driving the display apparatus of the present invention and a current amount variation.

FIG. 6 illustrates an embodiment in which the effect of the present invention appears the most remarkably.

A TS1 signal is a light emitting period control signal of an odd-numbered row of a display region, and a TS2 signal is a light emitting period control signal of an even-numbered row of the display region. When these signals are High, the light emitting elements emit light, and when these signals are Low, the light emitting elements do not emit light. In the display region, pixels are arranged in a two dimensional form of m rows by n columns (m and n are natural numbers).

A data line sequentially performs writing to each of the pixels. A signal for selecting rows to which writing is performed is caused to scan m rows. The TS1 signal and the TS2 signal also sequentially scan odd-numbered rows and even-numbered rows respectively. The TS1 and TS2 signals are caused to scan in the row directions, and therefore, the light emission pattern of FIG. 6 represents on/off timings in a plurality of representative rows in equidistant positions within the display region. A light emission pattern (A) is a light emission pattern of the first row of the display region (the row to which the data signal is written first), and shows the light emission corresponding to the TS1 signal. A light emission pattern (B) is a light emission pattern of the second row (the row to which the data signal is written second), and shows the light emission corresponding to the TS2 signal. As for the following light emission patterns, the light emission pattern of each of the rows at a constant space from the first row is shown by a set of two rows. The start of light emission of each row is delayed by the scanning time of the space. Two patterns (I) and (J) shown by the broken line in the lower stage of FIG. 6 represents the on-off signals of the virtual scanning line during the vertical blanking period, and the row which is actually scanned in this timing is not present. Specifically, the vertical blanking period is the period in which data is not input in any pixel. A writing period is included in one field period, but the writing period is omitted in FIG. 6.

In FIG. 6, two light emitting period control signals are included, but the display apparatus of the present invention can have two or more controls signals. The light emitting elements are divided into the group of odd-numbered rows (the row to which the data signal is written in odd-numbered turns) and the group of even-numbered rows (the row to which the data signal is written in even-numbered turns). Further, the light emitting elements are divided into the groups each of which includes the light emitting elements of the odd-numbered row and the next even-numbered row in sequence from the first row.

The current of two rows illustrated in FIG. 6 represents the sum of the currents that flow into the light emitting elements that emit light in the respective rows of the light emission patterns (A) and (B). When (A) is not lit, (B) is lit, and therefore, even if time changes, the sum of the currents does not change.

Further, ΣI illustrated in FIG. 6 represents a sum of the currents that flow into the light emitting elements that emit light in each of the rows at each timing, that is, a total current amount (set as ΣI) that flows into the display region. In the adjacent rows, substantially the same data is frequently written in general. Therefore, the currents for the two rows do not change so much with respect to time, and therefore, change of ΣI is also suppressed.

In this manner, by dividing the respective light emitting elements into the groups of the light emitting elements having different light emitting timings by using a plurality of light emission pattern signals, a variation of the sum of the total current amount flowing into the display region can be suppressed. The essence of the present invention is to change the light emitting timing according to light emitting elements so as to be able to suppress a variation of the sum of the total current amount flowing in the display region.

Hereinafter, the best mode for carrying out the display apparatus according to the present invention will be specifically described by referring to the drawings in a first to a third embodiments. The present embodiments relate to a drive method that is applied to an active matrix type display apparatus using organic EL elements, and that obtains favorable display while performing on-off drive. Further, the display apparatus of the present invention is not limited to a display apparatus using organic EL elements, but can be applied to any apparatus that can control light emission of self luminous elements.

[First Embodiment]

Figure 1:
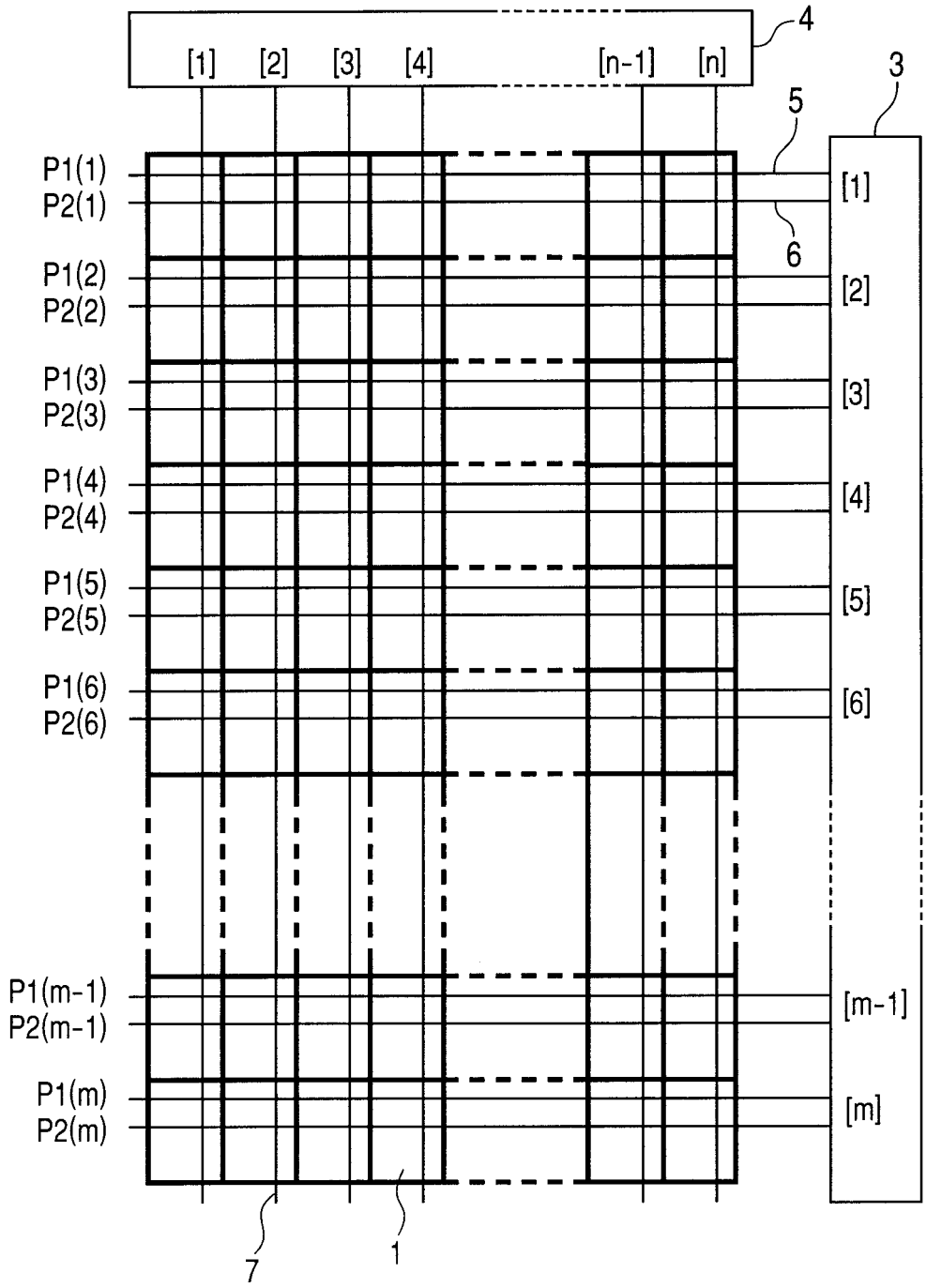
FIG. 1 is a view illustrating a display apparatus of the present invention.

FIG. 1 illustrates an entire arrangement of a display apparatus of the present embodiment. The display apparatus of FIG. 1 includes an image display section (hereinafter, sometimes called "a display region") in which pixels 1 are arranged in a two-dimensional form of m rows by n columns (m and n are natural numbers). The pixel 1 has a pixel circuit 2 (see FIG. 2) including the same number of organic EL elements as the number of prime colors of RGB, and transistors for controlling a current or a voltage to be input to the organic EL elements. As the transistors for use in the pixel circuit 2, TFTs can be used.

Further, the display apparatus of FIG. 1 includes in a periphery of the display region, a row control circuit 3 that is a unit that controls the operation of the pixel circuit 2, and a column control circuit 4 that is a unit that supplies a gradation display data corresponding to a data signal (video signal) to the pixel circuit 2. Any circuit that can control the operation of the pixel circuit 2 can be adopted other than the row control circuit 3, and any circuit that can supply gradation display data corresponding to the data signal to the pixel circuit 2 can be adopted other than the column control circuit 4.

From the respective output terminals of the row control circuit 3, scanning signals P1(1) to P1(m) that control writing of the data signal to the pixel circuit 2, and light emitting period control signals P2(1) to P2(m) that control supply of a current or a voltage to the light emitting elements are output. The scanning signal P1 that is one of the control signals output from the respective output terminals of the row control circuit 3 is input to the pixel circuits 2 of each of the rows via a scanning line 5. The light emitting period control signal P2 that is the other control signal is input to the pixel circuits 2 of each of the rows via a light emitting period control signal line 6. If the writing of the data signal to the pixel circuit 2 can be controlled, use of the scanning signal P1 can be omitted.

The data signal is input to the column control circuit 4, and a data voltage (voltage signal) Vdata that is gradation display data is output from each of the output terminals of the column control circuit 4. The data voltage Vdata that is output from the column control circuit 4 is input to the pixel circuits 2 of each of the columns via a data line 7.

Figure 2:
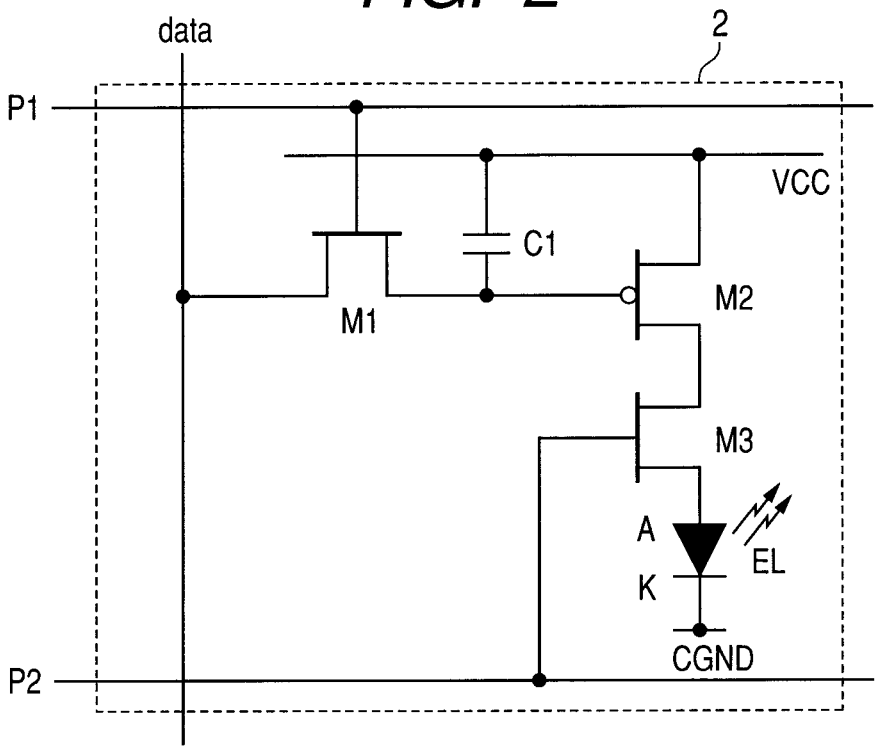
FIG. 2 is a diagram illustrating a pixel circuit that can be used in the display apparatus of the present invention.

FIG. 2 is the pixel circuit 2 including an organic EL element that can be used in the display apparatus of the present embodiment. A drive method thereof is as follows.

FIG. 2 illustrates a scanning signal P1 and a light emitting period control signal P2. As a data signal, the voltage signal Vdata that is gradation display data is input. An anode of an organic EL element is connected to a drain terminal of a TFT (M3), and a cathode is connected to a ground potential CGND. A TFT M2 is a P type TFT, whereas M1 and M3 TFTs are N type TFTs. Further, The TFT M2 is a light emitting element drive unit that supplies a current or a voltage corresponding to the data signal to a light emitting element, and the TFT M3 is a light emitting period control unit that controls the light emitting period of the light emitting element by the light emitting period control signal.

Figure 3:
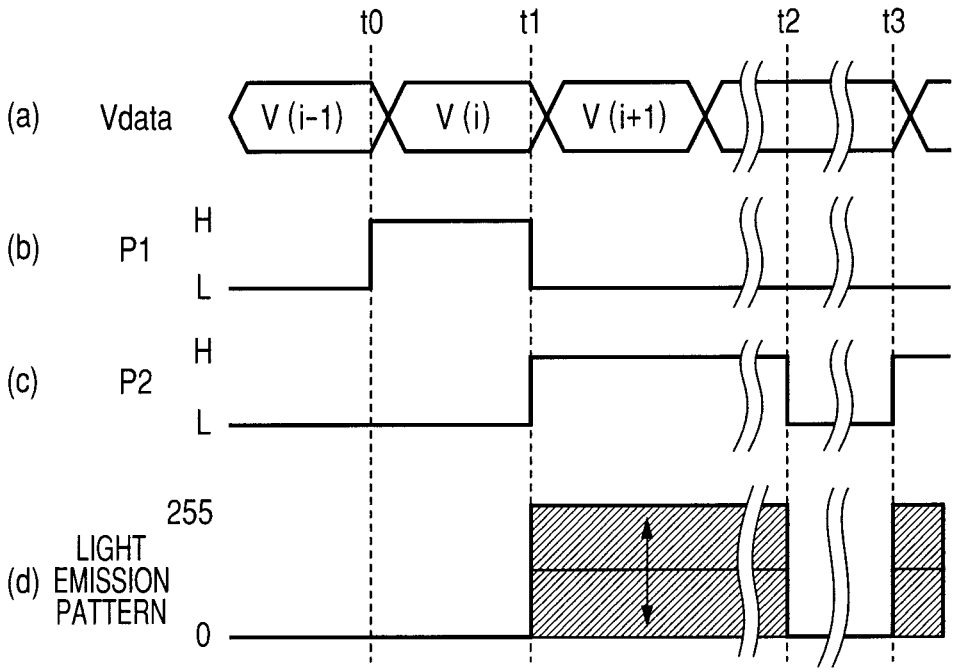
FIG. 3 is a timing chart illustrating a method for driving the pixel circuit of FIG. 2.

FIG. 3 is a timing chart that illustrates a method for driving the pixel circuit 2.

In FIG. 3, V(i−1), V(i) and V(i+1) represent the data voltages Vdata that are input to the pixel circuits 2 of the target columns of an i−1 row (the row to which the data signal is written immediately before the target row) in the field unit, an i row (the target row to which the data signal is written), and i+1 row (the row to which the data signal is written immediately after the target row).

First, at the point of time before a time to, to the pixel circuit 2 of the target row, signals at low levels are input for the scanning signal P1 and the light emitting period control signal P2. The transistors M1 and M3 are in an OFF state. In this state, to the pixel circuit 2 of m row that is the target row, V(i−1) corresponding to the data voltage Vdata that is the gradation display data of the immediately preceding row is not input.

Next, at the point of time before a time t1, a signal at a high level is input to P1, whereas a signal at a low level is input to P2, and the transistor M1 is turned ON, whereas the transistor M3 is turned OFF. In this state, V(i) corresponding to the data voltage Vdata that is the gradation display data of the row is input to the pixel circuit 2 of the m row. The input data voltage Vdata is charged into a capacitor C1 that is disposed between the gate terminal of M2 and a power supply potential VCC.

Subsequently, at the time t1, a signal at a low level is input to P1, and a signal at a high level is input to P2, which causes M1 to be an OFF state, and M3 to be an ON state. In this state, M3 is in a conducting state, and therefore, by the voltage charged into C1, the current corresponding to the current drive ability of M2 is supplied to the organic EL element. Thereby, the organic EL element emits light in the pattern as in (d) of FIG. 3 with the luminance corresponding to the data signal.

Subsequently, at a time t2, a signal at a low level is input to P2 and M3 is turned off, and thereby the current supply to the organic EL element stops causing a non-light emitting state. The light emitting period is controlled by changing the period in which P2 is at a high level and the timing at which P2 is turned to a high level.

Thereafter, at a time t3, a signal at a high level is input to P2 and M3 is turned on, and thereby the current to the organic EL element is supplied causing a light emitting state. The non-light emitting period is controlled by changing the period in which P2 is at a high level.

The period in which P1 is a high-level signal from the time t0 to the time t1 is the time relating to scanning of one row, and this is set as the scanning period of one row. Further, a total period of a continuous pair of the period in which P2 is at a high level and the period in which P2 is at a low level, which is specified in the duration from the time t1 to the time t3, is set as a light emitting cycle.

In the above description, as the pixel circuit 2, the configuration of FIG. 2 is cited as one example, but the pixel circuit for use in the display apparatus of the present invention is not limited to this.

Figure 4:
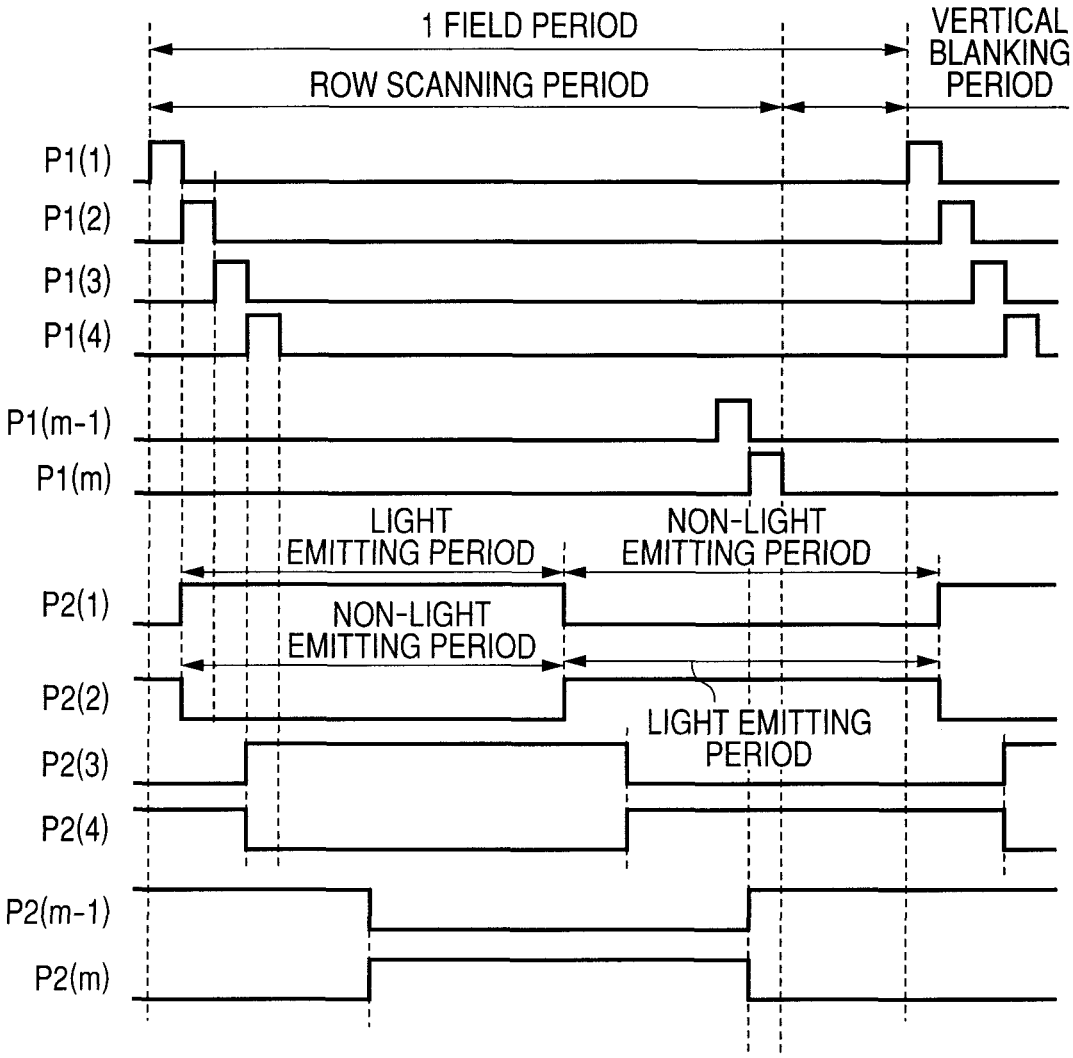
FIG. 4 is a timing chart describing a method for driving a first embodiment.

FIG. 4 is a timing chart illustrating a method for driving the display apparatus of the present embodiment.

In FIG. 4, P1(1) to P1(m) represent the scanning signals P1 corresponding to the first row (the row to which the data signal is written first) to the $m^{th}$ row (the row in which the data signal is written $m^{th}$). P2(1) to P2(m) represent light emitting period control signals P2 corresponding to the first row to the $m^{th}$ row.

In the row scanning period, the scanning signals P1(1), P1(2), P1(3), . . . , P1(m) of the first row, the second row, the third row, . . . , the $m^{th}$ row are each sequentially turned to a high level for one scanning period. In the high level period, the voltage signal Vdata that is gradation display data is input to the pixel circuit 2. That is, the data signal is written to the pixel circuit 2.

In the present embodiment, the two groups having different light emitting timings of the light emitting elements are set as the group of the odd-numbered rows and the group of the even-numbered rows. At this time, the light emitting period control signal P2 controls light emission of the light emitting elements for two groups in different timings, and therefore, scan is performed with the light emitting period control signal P2 for an odd-numbered row (2k−1) (k is a natural number) and the light emitting period control signal P2 (2k) for an even-numbered row. More specifically, the respective light emitting elements are controlled by the different control signal according to the groups, and the light emitting timing for the writing period differs according to the groups. Further, each of the light emitting elements has a light emitting period and a non-light emitting period in one field period, and has an equal light emission duty. P2 (2k−1) enters a high level period and a light emitting state after the voltage signal Vdata that is gradation display data is input. Thereafter, the P2 (2k−1) enters a low level period and a non-light emitting state. Meanwhile, P2 (2k) enters a low level period and a non-light emitting state at the same time when the voltage signal Vdata that is the gradation display data is input. Thereafter, P2 (2k) enters a high level period and a light emitting state.

FIG. 4 is an example of the case with the light emission duty of 50%, in which the timing at which the P2 (2k−1) is turned to a high (or low) level and the timing at which the P2 (2k) is turned to a low (or high) level correspond to each other. Therefore, in the unit of two rows, only either one is always in the light emitting state, and with the same Vdata, the current amount that flows into the light emitting element does not change according to time.

Figure 5:
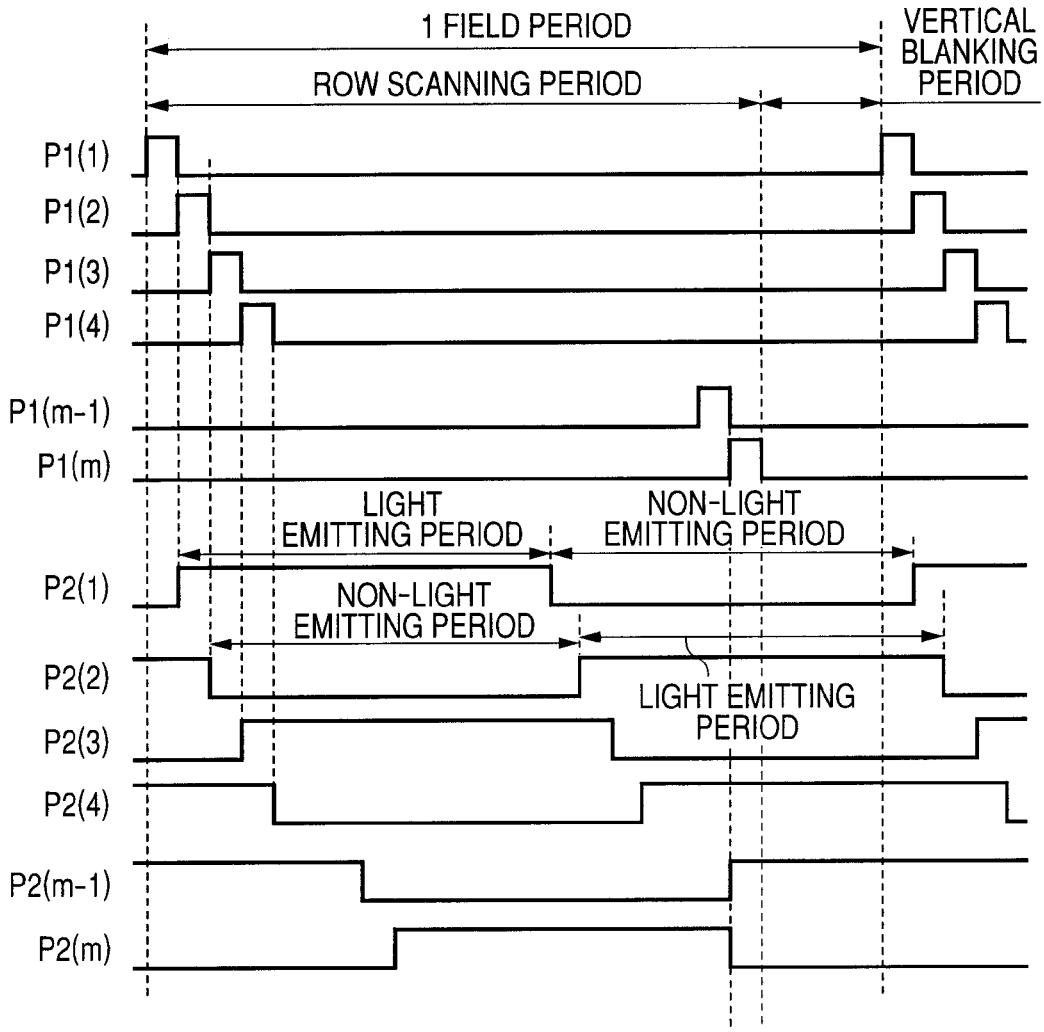
FIG. 5 is a timing chart describing the method for driving the first embodiment.

FIG. 5 is also an example of the case with the light emission duty of 50%, but unlike FIG. 4, the timing at which the P2(2k−1) is turned to a high (or low) level and the timing at which the P2(2k) is turned to a low (or high) level do not correspond to each other. Therefore, the light emitting periods partially overlap each other. However, when the period in which the light emitting periods overlap each other is shorter than double the pulse period of P1, that is, the period is shorter than double the (1 field/the number of rows to which writing is done), only either one row is in the light emitting state in most of the period in the unit of two rows. With the same Vdata, the current amount flowing into the light emitting element hardly changes according to time, and even if the drive as in FIG. 5 is performed, a substantially equivalent effect to that of the drive of the timing of FIG. 4 is obtained. Hereinafter, in both of the cases of FIGS. 4 and 5, it will be indicated that "the light emitting periods do not overlap each other".

In FIGS. 4 and 5, in the drive of the case of the light emission duty of 50%, writing of the data signal is performed in sequence from the first row to cause the light emitting elements to emit light, so that the light emitting periods of the light emitting elements of the $(2k-1)^{th}$ row and the $2k^{th}$ row do not overlap each other. Therefore, the respective light emitting elements arranged in the adjacent rows differ in the light emitting timing. However, the display apparatus and the method for driving the same of the present invention are not limited to this. If the light emitting periods of the light emitting elements of the row to which the data signal is written $(2k-1)^{th}$, and the row to which the data signal is written $2k^{th}$ do not overlap each other, the light emitting elements do not have to be divided into the two groups of the odd-numbered rows and the even-numbered rows, and the number of light emitting period control signals does not have to be two.

Further, in each of FIGS. 4 and 5, each of a light emitting and non-light emitting periods take place once in one field period, but the light emitting and non-light emitting periods may be repeated a plurality of times in one field period.

As above, according to the present embodiment, the light emission group is divided into two, and in the drive of the case of the light emission duty of 50%, the light emission is controlled so that when one group emits light, the other group does not emit light, and only either group always emits light. This is one of the examples of the drive state in which the effect of the present invention is exhibited the most remarkably. Accordingly, the number of light emitting elements that emit light is always constant, and a variation of ΣI (total current amount flowing into the display region) can be suppressed. That is, the power supply variation due to existence of the power supply impedance can be suppressed, which allows for favorable display, where degradation of the image quality accompanying the luminance change caused by a power supply variation is suppressed.

Further, in the above description, the light emitting elements are divided into the two groups having different light emitting timings for the data signal writing period, but the light emitting elements may be divided into three or more groups. In this case, the light emission group is divided into N (N is a natural number of 3 or larger), and in the drive of the case of the light emission duty of (100/N) %, control can be applied so that when one group emits light, the other group does not emit light, and only one group out of N groups always emits light. In concrete, the rows from one row through N row are divided into N groups, and the rows from (N+1) row through (N+N) row are divided into N groups. Grouping is similarly repeated, and the rows from (Nk−(N−1)) row through Nk row are divided into N groups (k is a natural number). Subsequently, control can be applied so that the light emitting period of the light emitting elements of the row included in a certain light emission group from the $(Nk-(N-1))^{th}$ row through the $Nk^{th}$ row does not overlap with the light emitting period of the light emitting elements of the row included in the other light emission group from the $(Nk-(N-1))^{th}$ row through the $Nk^{th}$ row. As the grouping method of each group, for example, from one end of the display region toward the other end, each row can be allocated to N groups in sequence from the end.

[Second Embodiment]

An entire configuration of a display apparatus of the present embodiment is similar to that of FIG. 1, and the pixel circuit 2 and a method for driving the same are also similar to those in FIGS. 2 and 3. Therefore, the description and the drawings of them will be omitted.

Figure 7:
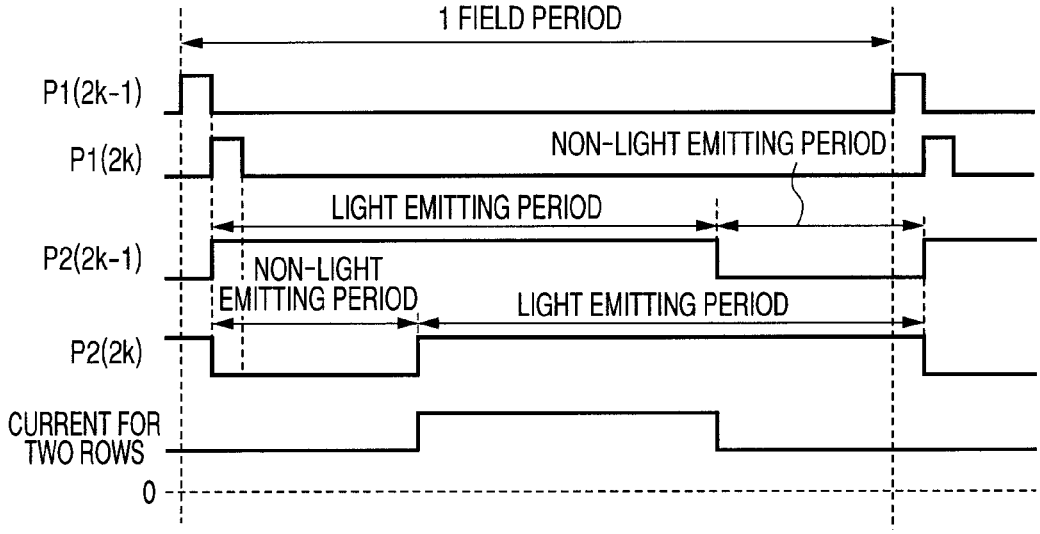
FIG. 7 is a timing chart describing a method for driving a second embodiment.
Figure 8:
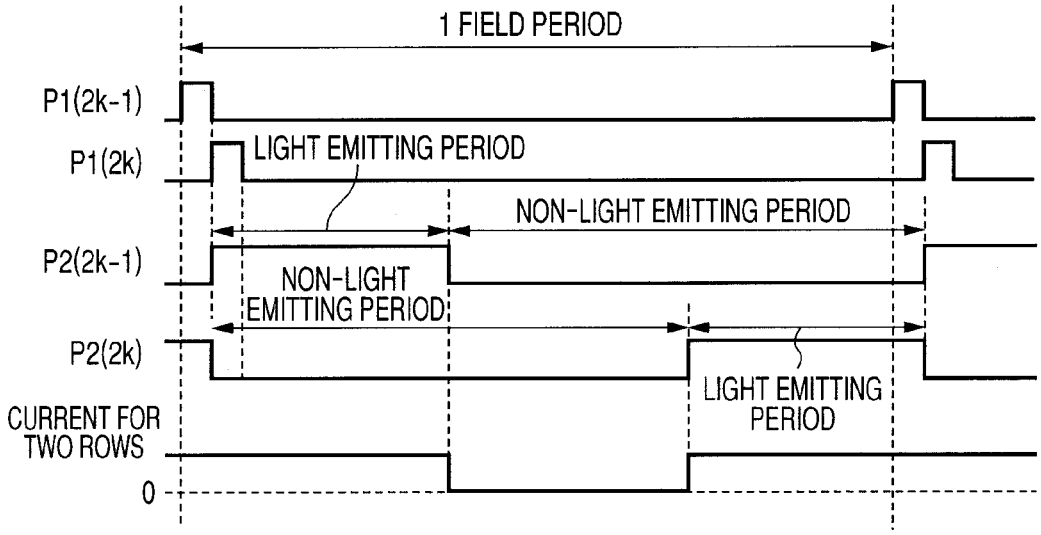
FIG. 8 is a timing chart describing the method for driving the second embodiment.
Figure 9:
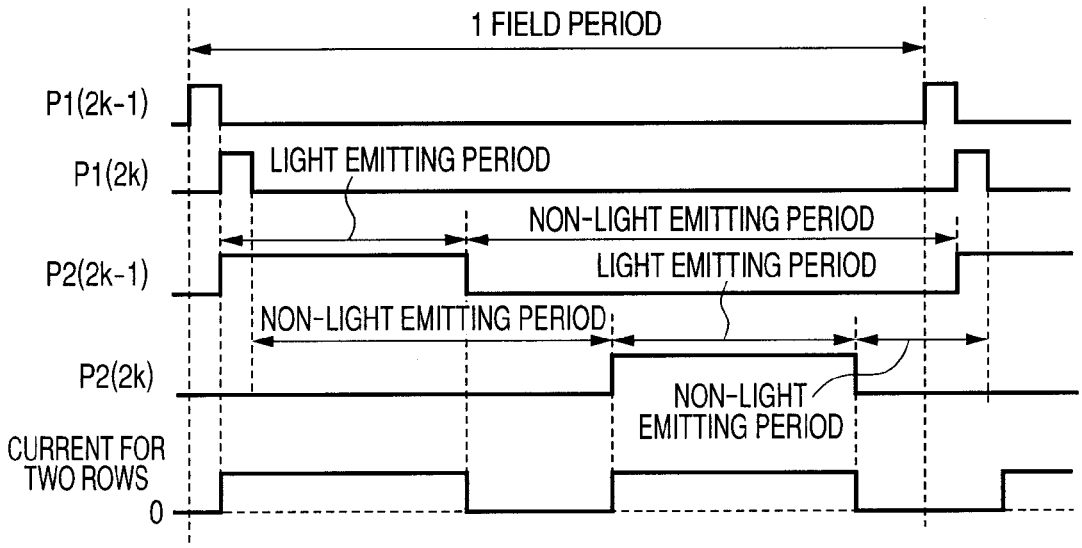
FIG. 9 is a timing chart describing the method for driving the second embodiment.

FIGS. 7 to 9 are timing charts illustrating the drive method in the present embodiment.

In the present embodiment, as in the first embodiment, two groups having different light emitting timings of the light emitting elements are also set as the group of odd-numbered rows and the group of even-numbered rows.

FIGS. 7 to 9 illustrate P1(2k−1) that is the scanning signal P1 corresponding to the odd-numbered rows from the first row to the $m^{th}$ row, and P1(2k) that is the scanning signal P1 corresponding to the even-numbered rows from the first row to the $m^{th}$ row. P2(2k−1) that is the light emitting period control signal P2 corresponding to the odd-numbered rows of the first row to the $m^{th}$ row, and P2(2k) that is the light emitting period control signal P2 corresponding to the even-numbered rows of the first row to the $m^{th}$ row are illustrated. Both the P1 and P2 are caused to scan the respective rows, and therefore, in the first row to the $m^{th}$ row, the timing differs in each of the rows. What differs from the drive method described with the timing chart of FIG. 4 is the waveform of the light emitting period control signal P2.

FIG. 7 is an example of the case of the light emission duty of more than 50%. The light emitting elements are divided into two groups having different light emitting timings. The light emitting timing is set so that if one group is in a non-light emitting state, the other group is ensured to be in a light emitting state. Further, the light emission duty is larger than 50%, and therefore, the period exists, in which when one group is in the light emitting state, the other group is in a light emitting state. Therefore, in the unit of two rows, at least either one row is always in the light emitting state. With the same Vdata, as for the current amount flowing into the light emitting elements, the period in which the current for one row flows and the period in which the current for two rows flows coexist. However, the state in which the current does not flow does not take place.

FIG. 8 is an example of the case of the light emission duty of less than 50%. The light emitting elements are divided into two groups having different light emitting timings. The light emitting timing is set so that if one group is in the light emitting state, the other group is ensured to be in the non-light emitting state. Further, the light emission duty is smaller than 50%, and therefore, the period exists, in which when one group is in the non-light emitting state, the other group is in the non-light emitting state. Therefore, in the unit of two rows, at least either one row is always in the non-light emitting state. With the same Vdata, as for the current amount flowing into the light emitting elements, the period in which the current does not flow, and the period in which the current for one row flows coexist. However, the state where the current for two rows flows does not take place.

FIG. 9 is also an example of the case of the light emission duty of less than 50%, but unlike FIG. 8, in substantially the middle of the non-light emitting period of one group, the light emitting period of the other is set. The sum of the current amounts in the unit of two rows is the same as that of FIG. 8, but as for the current amount flowing into the light emitting element, the period in which the current does not flow and the period in which the current for one row flows are dispersed by time as compared with FIG. 8. The light emission timing may be set like this.

FIGS. 7 and 8 each illustrate a timing chart in which in the timing of fall of the P1(2k−1) signal, the rise or the fall of P2(2k−1) and P2(2k) are aligned. However, the timing of rise or fall of P2 (2k) may be shifted to the timing of fall of P1(2k) signal. In this case, the current amount of two rows differs from the other current amount for a short period of time in which P1 becomes high. However, the period is a very short period in one field period, and the variation of the current amount at this time hardly influences the effect of the present invention. Therefore, even if the rise or fall timing of P2 (2k) is shifted to the timing of fall of the P1 (2k) signal, the effect substantially equivalent to the drive with the timings of FIGS. 7 and 8 can be obtained.

Figure 11:
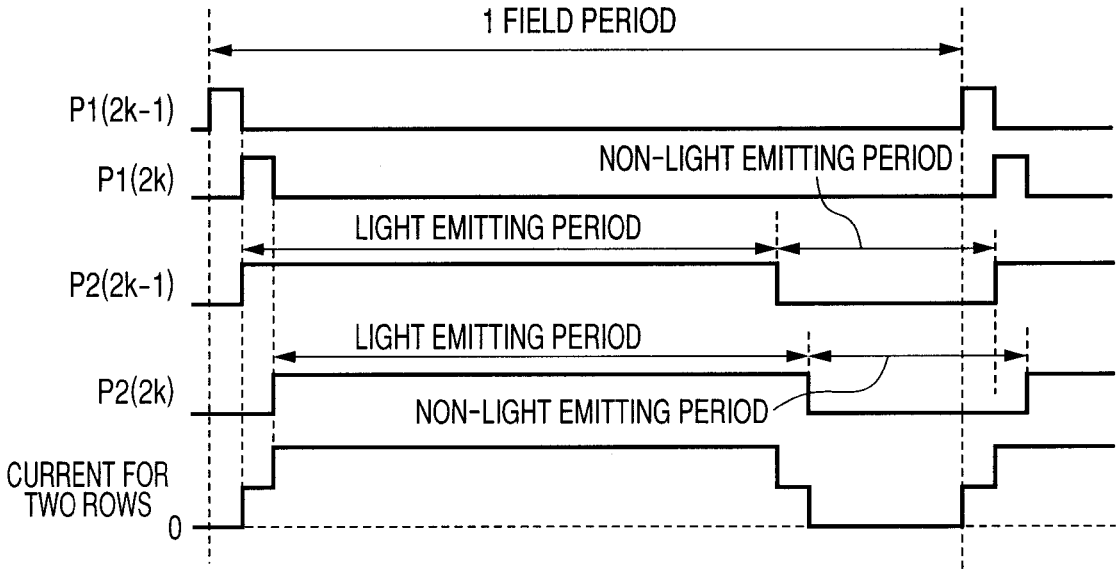
FIG. 11 is a diagram illustrating a method for driving a conventional display apparatus and a current amount variation.
Figure 12:
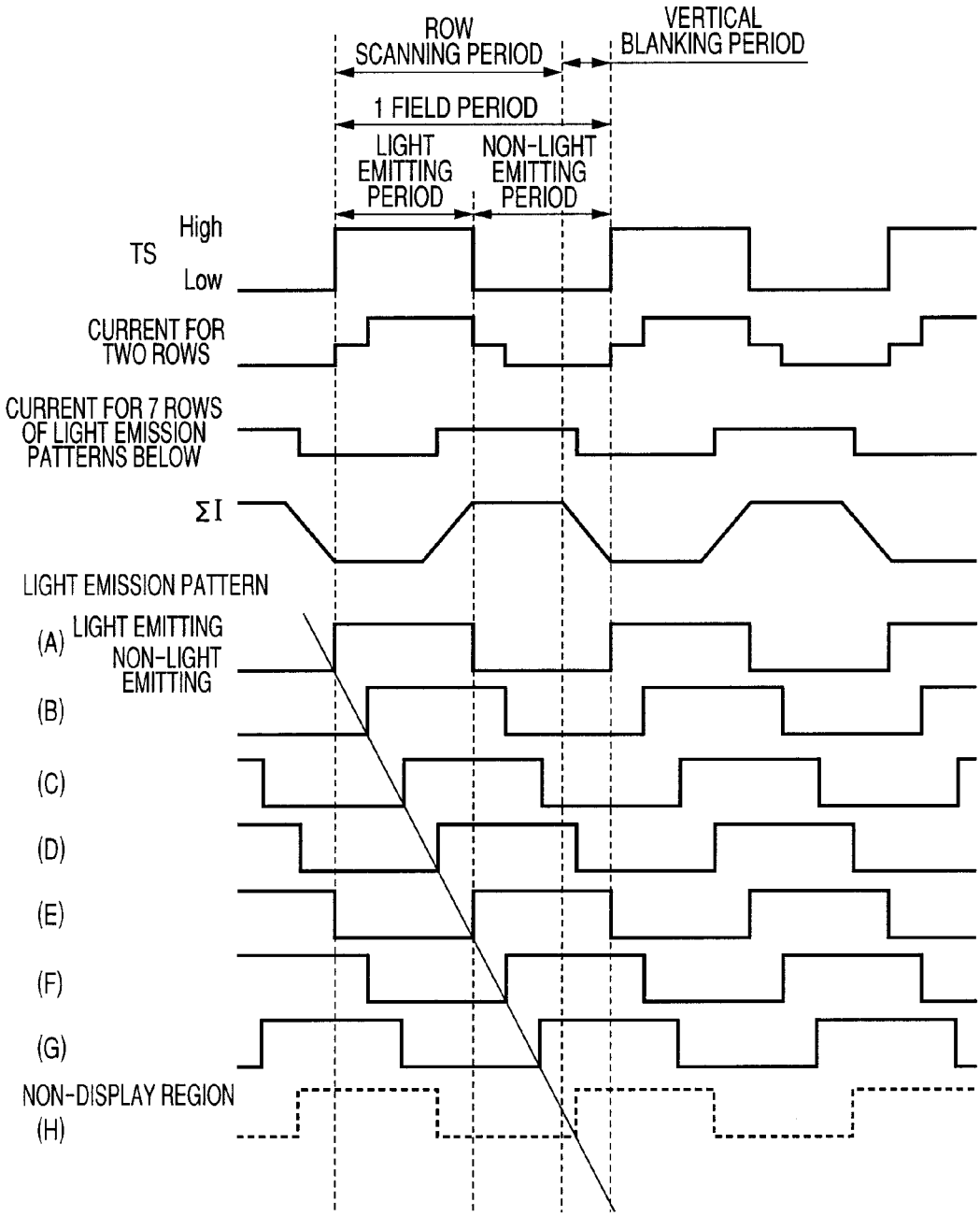
FIG. 12 is a diagram illustrating the method for driving the conventional display apparatus and a current amount variation.

Here, FIGS. 11 and 12 are timing charts illustrating a drive method according to the prior art. The P2 is caused to scan each row, and as for the current amount in the unit of two rows, the period in which the current does not flow, the period in which the current for one row flows, and the period in which the current for two rows flows coexist.

In FIGS. 7 to 9, the variation amount of the current for two rows becomes not more than a half as compared with the variation amount of the current for two rows in the prior art of FIG. 11.

Figure 10:
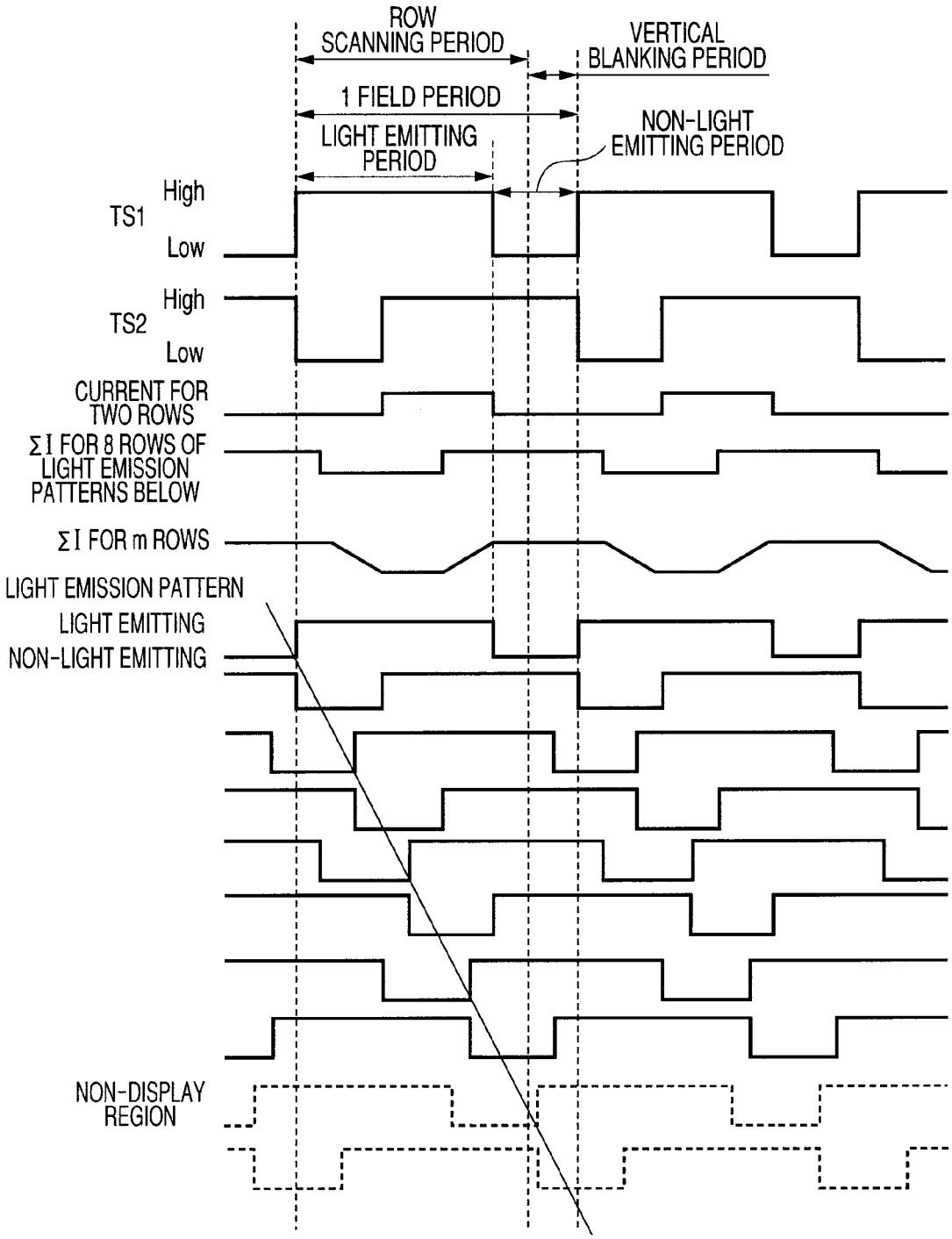
FIG. 10 is a diagram illustrating the method for driving the display apparatus of the present invention and a current amount variation.

FIG. 10 illustrates the variation of the total current amount that flows into the display region at the time of drive by the timing of FIG. 7. A TS1 signal is a light emitting period control signal for the odd-numbered rows of the display region, and a TS2 signal is a light emitting period control signal for the even-numbered rows of the display region. When each of the TS1 signal and the TS2 signal is high, the light emitting elements emit light, and when each of them is low, the light emitting elements do not emit light. A data line sequentially writes to each pixel. A signal that selects the row to be subjected to write is caused to scan m rows, the TS1 signal and the TS2 signal respectively scan the odd-numbered rows and the even-numbered rows in sequence. The TS1 and TS2 signals are caused to scan in the row directions, and therefore, the light emission pattern of FIG. 10 represents on-off timings in a plurality of rows in equidistant positions within the display region. The uppermost stage of the light emission pattern is a light emission pattern of the first row of the display region, and represents the light emission corresponding to the TS1 signal. The following light emission patterns represent the light emission pattern of the respective rows separated at constant spaces from the first row. The start of light emission of each row is delayed by the scanning time of the space. Two patterns shown by the broken line in the lower stage of FIG. 10 represents the on-off signals of the virtual scanning line during the vertical blanking period, and the row which is actually scanned and emits light in this timing is not present. As for the current corresponding to two rows, the period in which the current for one row flows and the period in which the current for two rows flows coexist. The total current amount ΣI flowing into the display region varies according to time as in FIG. 10. However, as compared with the prior art of FIG. 12, the variation amount is a half or less. While the writing period is included in one field period, the writing periods are omitted in FIGS. 10 and 12.

Further, in the case of the light emission duty of less than 50%, when the light is emitted with the timing chart as in FIG. 9, the effect of suppressing the variation of the total current amount ΣI flowing into the display region becomes larger than when the light is emitted with the timing chart as in FIG. 8, and this is more suitable. This is because, when focusing on the change amount of the sum of the currents for two rows, the period in which the current does not flow is present only one time in the substantially middle of one field period in FIG. 8, but two such periods are distributed in FIG. 9. When the current is integrated by m rows, the variation of the total current amount ΣI is more easily suppressed when the period in which the current flows and the period in which the current does not flow are dispersed.

In FIG. 7, in the drive of the case of the light emission duty of more than 50%, writing of the data signal is performed in sequence from the first row to cause the light emitting elements to emit light, so that the non-light emitting periods of the light emitting elements of the $(2k-1)^{th}$ row and the $2k^{th}$ row do not overlap each other. However, the display apparatus and the method for driving the same of the present invention are not limited to this. If the non-light emitting periods of the light emitting elements of the row to which the data signal is written $(2k-1)^{th}$ and the row to which the data signal is written $2k^{th}$ do not overlap each other, the light emitting elements do not have to be divided into the two groups of the odd-numbered rows and the even-numbered rows, and the number of light emitting period control signals does not have to be two.

In FIGS. 8 and 9, in the drive of the case of the light emission duty of less than 50%, writing of the data signal is performed in sequence from the first row to cause the light emitting elements to emit light, so that the light emitting periods of the light emitting elements of the $(2k-1)^{th}$ row and the $2k^{th}$ row do not overlap each other. However, the display apparatus and the method for driving the same of the present invention are not limited to this.

If the light emitting periods of the light emitting elements of the row to which the data signal is written $(2k-1)^{th}$ and the row to which the data signal is written $2k^{th}$ do not overlap each other, the light emitting elements do not have to be divided into two groups of the odd-numbered rows and the even-numbered rows, and the number of light emitting period control signals does not have to be two.

Further, while the light emitting and non-light emitting periods take place once in one field period in FIGS. 7 to 9, it is more preferable to repeat the light emitting and non-light emitting periods for a plurality of times in one field period, which allows for larger effect of suppressing the variation of the total current amount ΣI that flows into the display region.

Further, in FIGS. 7 and 8, in one field period, light emission start or non-light emission start of the (2k−1) row and (2k) row are aligned at the timing of end of the data writing period of the (2k−1) row. However, in practice, the effect of the present invention can be sufficiently obtained even if the starts of light emission or starts of non-light emission of the (2k−1) row and (2k) row are not at the same timing. For example, even if the light emitting period of P2(2k) is shifted to be earlier or later by the programming period of the (2k) row (the period in which P1(2k) is high), the effect of suppressing the variation of the current amount in one field period can be sufficiently obtained.

As above, according to the present embodiment, the light emission group is divided into two, and when the light emission duty is larger than 50%, light emission is controlled so that when one group does not emit light, the other group emits light. In this manner, the period in which the two groups do not pass a current at the same time is hardly present in one field period. Further, when the light emission duty is smaller than 50%, light emission is controlled so that when one group emits light, the other group does not emit light. In this manner, the period in which the two groups pass the current at the same time is hardly present in one field period. As a result, variation of ΣI (total current amount flowing into the display region) can be suppressed, and power supply variation due to existence of the power supply impedance can be suppressed. Thereby, favorable display can be achieved, in which degradation of the image quality accompanying the luminance change caused by a power supply variation is suppressed.

Further, in the present embodiment, the light emitting elements are divided into two groups differing in light emitting timing for the data writing period, but the light emitting elements can be divided into three groups or more. In this case, the light emission groups are divided into N (N is a natural number larger than two), and in the drive of the case of the light emission duty of more than (100/N) %, control can be applied so that when one group emits light, the other two groups or more do not emit light, and three groups or more out of N groups do not emit light at all times. More accurately, control can be applied so that the light emitting period of the light emitting elements from the $(Nk-(N-1))^{th}$ row to the $Nk^{th}$ row does not overlap with the light emitting period of the light emitting elements of the other two or more rows from the $(Nk-(N-1))^{th}$ row to the $Nk^{th}$ row. In the drive of the case of the light emission duty of less than (100/N) %, control can be applied so that when one group emits light, the other group does not emit light, and only one group out of N groups always emits light. More accurately, the light emitting period of the light emitting elements from the $(Nk-(N-1))^{th}$ row to the $Nk^{th}$ row does not overlap with the light emitting period of the light emitting elements of the other row from the $(Nk-(N-1))^{th}$ row to the $Nk^{th}$ row. In the case of the light emission duty of more than (100/N) %, and in the case of the light emission duty of less than (100/N) %, for example, allocation of the respective rows to N groups in sequence from the first row is suitable as the grouping method.

[Third Embodiment]

The present embodiment is an example of use of the display apparatus of the present invention in electronic equipment.

Figure 13:
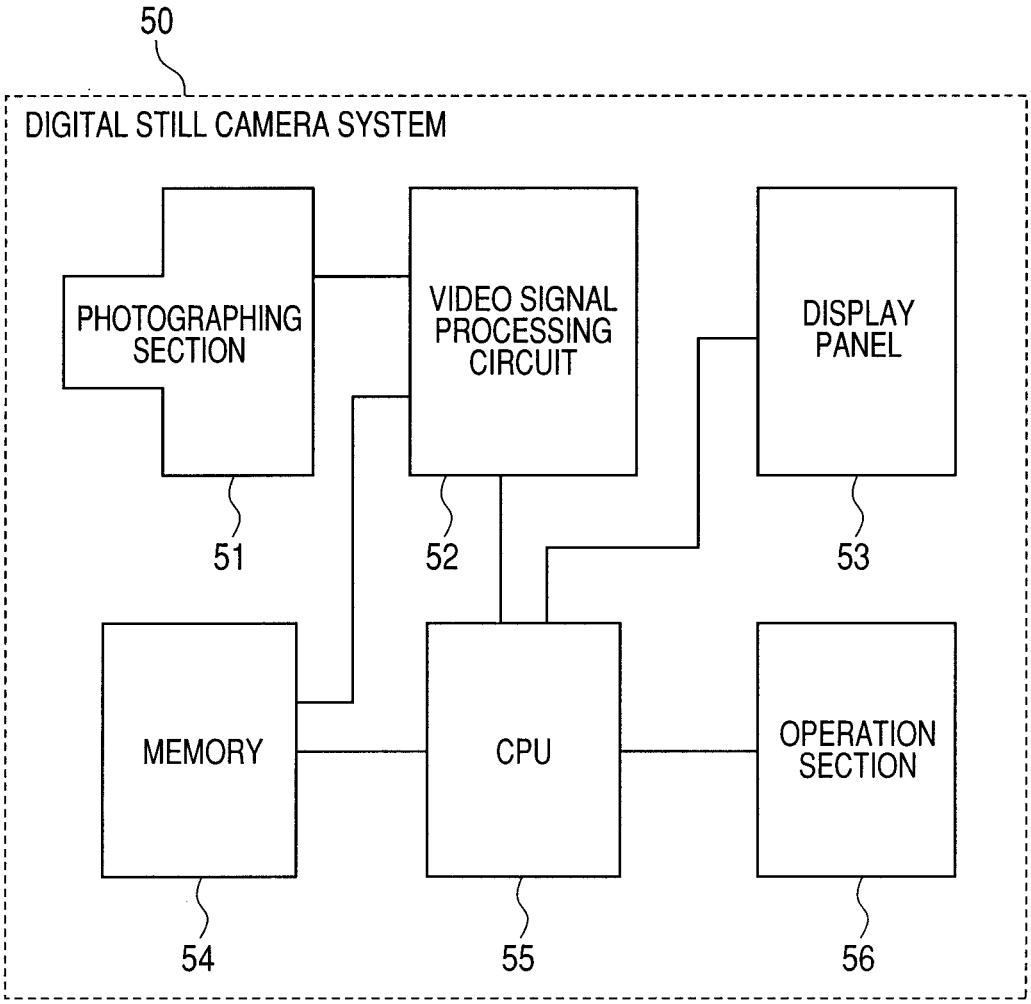
FIG. 13 is a block diagram of a digital still camera using the display apparatus of the present invention.

FIG. 13 is a block diagram of one example of a digital still camera system of the present embodiment. FIG. 13 illustrates a digital still camera system 50, a photographing section 51, a video signal processing circuit 52, a display panel 53, a memory 54, a CPU 55 and an operation section 56. The display apparatus of the present invention is used for the display panel 53.

In FIG. 13, the video that is photographed by the photographing section 51 or the video recorded in the memory 54 is subjected to signal processing in the video signal processing circuit 52, and can be watched on the display panel 53. In the CPU 55, by input from the operation section 56, the photographing section 51, the memory 54, the video signal processing circuit 52 and the like are controlled, and photographing, recording, reproduction and display suitable for the situation are performed. Further, the display panel 53 can be used as a display section of various kinds of electronic equipment in addition to this example.

By using the display apparatus according to the present invention, for example, an information display apparatus can be configured. The information display apparatus takes the mode of any one of, for example, a cellular phone, a portable computer, a still camera and a video camera. Alternatively, the information display apparatus is the one that realizes a plurality of the functions of them. The information display apparatus includes an information input section. For example, in the case of a cellular phone, the information input section is adapted to include an antenna. In the case of a PDA or a portable PC, the information input section is adapted to include an interface section to a network. In the case of a still camera or a movie camera, the information input section is adapted to include a sensor section by a CCD, a CMOS or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-175967, filed Jul. 29, 2009, which is hereby incorporated by reference herein in its entirety.

What is claimed is:

1. A display apparatus, comprising:

a plurality of pixels arranged in two-dimensions, each pixel including a pixel circuit and a light emitting element for emitting light at a luminance corresponding to a data signal;

a data line, connected to each pixel circuit, for writing the data signal; and a light emitting period control signal line for supplying a light emitting period control signal, with each pixel circuit comprising:

a light emitting element drive unit for supplying a current or voltage corresponding to the data signal to the light emitting element; and a light emitting period control unit for controlling a light emitting period of the light emitting element by the light emitting period control signal, wherein the light emitting period control signals have two or more light emitting period control signals, the respective pixels are divided into two or more groups by grouping the respective pixels disposed in a same row at least into a same group, pixels in a same row are scanned in every other row and neighboring rows are sequentially scanned for writing the data signal, the light emitting elements have an equal light emission duty, and the light emitting elements are controlled by the light emitting period control signal different on a group basis and controlled so that a time between an endpoint of a writing period within one field period and a start point of a light emitting period within the one field period is different for different groups.

2. The display apparatus according to claim 1, wherein the group comprises a first group comprising the pixels of odd-numbered rows and a second group comprising the pixels of even-numbered rows.

3. The display apparatus according to claim 2, wherein each of the light emitting elements emits light with the light emission duty of not more than 50%, and light emitting periods of the light emitting elements of a $(2k-1)^{th}$ row and a $2k^{th}$ row do not overlap each other, or each of the light emitting elements emits light with the light emission duty of more than 50%, and non-light emitting periods of the light emitting elements of the $(2k-1)^{th}$ row and the $2k^{th}$ row do not overlap each other, where k is a natural number.

4. The display apparatus according to claim 1, wherein the group comprises N groups, respective rows are allocated to N groups in sequence from a first row, the respective light emitting elements emit light with the light emission duty of not more than (100/N) %, and a light emitting period of the light emitting elements of an $(Nk-(-1))^{th}$ row to an $Nk^{th}$ row does not overlap with a light emitting period of light emitting elements of the other row of the $(NK-(-1))^{th}$ row to the $Nk^{th}$ row, or the respective light emitting elements emit light with the light emission duty of more than (100/N) %, and a light emitting period of the light emitting elements of the $(Nk-(-1))^{th}$ row to the $Nk^{th}$ row does not overlap with a light emitting period of light emitting elements of the other two or more rows of the $(Nk-(-1))^{th}$ row to the $Nk^{th}$ row, where N is a natural number that is three or larger and k is a natural number.

5. The display apparatus according to claim 1, wherein each light emitting element has a vertical blanking period of time in one field period.

6. The display apparatus according to claim 1, wherein the light emitting element is an organic EL element.

7. A digital camera system, comprising the display apparatus according to claim 1 as a display panel.

8. A method for driving a display apparatus having a plurality of pixels arranged in two-dimensions, each pixel including a pixel circuit and a light emitting element for emitting light, comprising:

a first step for writing a data signal to a pixel circuit in a pixel; and a second step for controlling a current or a voltage supply corresponding to the data signal to a light emitting element from a light emitting element drive unit by a light emitting period control signal, and causing the light emitting element to emit at a luminance corresponding to the data signal, wherein the light emitting period control signal has two or more light emitting period control signals, the pixels are divided into two or more groups by grouping the respective pixels disposed in a same row at least into a same group, pixels in a same row are scanned in every other row and neighboring rows are sequentially scanned for writing the data signal, the light emitting elements have an equal light emission duty, and in the second step, the light emitting elements are controlled by the light emitting period control signal different on the group basis, and controlled so that a time between an endpoint of a writing period within one field period and a start point of a light emitting period within the one field period is different for different groups.

9. The method for driving the display apparatus according to claim 8, wherein the groups comprise a first group comprising the pixels of odd-numbered rows and a second group comprising the pixels of even-numbered rows.

10. The method for driving the display apparatus according to claim 9, wherein in the second step, each of the light emitting elements emits light with the light emission duty of not more than 50%, and light emitting periods of the light emitting elements of a $(2k-1)^{th}$ row and a $2k^{th}$ row do not overlap each other, or each of the light emitting elements emits light with the light emission duty of more than 50%, and non-light emitting periods of the light emitting elements of the $(2k-1)^{th}$ row and the $2k^{th}$ row do not overlap each other, where k is a natural number.

11. The method for driving the display apparatus according to claim 8, wherein the group comprises N groups, respective rows are allocated to N groups in sequence from a first row, in the second step, the respective light emitting elements emit light with the light emission duty of not more than (100/N) %, and a light emitting period of the light emitting elements of an $(Nk-(-1))^{th}$ row to an $Nk^{th}$ row does not overlap with a light emitting period of the light emitting elements of the other row of the $(NK-(-1))^{th}$ row to the $Nk^{th}$ row, or the respective light emitting elements emit light with the light emission duty of more than (100/N) %, and the light emitting period of the light emitting elements of the $(Nk-(-1))^{th}$ row to the $Nk^{th}$ row does not overlap with a light emitting period of light emitting elements of the other two or more rows of the $(Nk-(-1))^{th}$ row to the $Nk^{th}$ row, where N is a natural number that is three or larger, and k is a natural number.

12. The method for driving the display apparatus according to claim 8, wherein each light emitting element has a vertical blanking period of time in one field period.

13. The method for driving the display apparatus according to claim 8, wherein the light emitting element is an organic EL element.

* * * * *